US006600396B1

(12) United States Patent
Rodriguez et al.

(10) Patent No.: US 6,600,396 B1
(45) Date of Patent: Jul. 29, 2003

(54) SIGNAL ACCESSORY FOR A MOLDED CASE CIRCUIT BREAKER

(75) Inventors: Mauricio Rodriguez, Duluth, GA (US); Elizabeth Blessitt, Peachtree City, GA (US); Bernard DiMarco, Lilburn, GA (US); Russell Green, Douglasville, GA (US); Günther Kachelrieb, Vasby (SE); Fritz Freidenstein, Duluth, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/802,576

(22) Filed: Mar. 12, 2001

Related U.S. Application Data

(63) Continuation of application No. 09/435,306, filed on Nov. 5, 1999, now abandoned.

(51) Int. Cl.[7] ..... H01H 67/02
(52) U.S. Cl. ..... 335/132; 335/17; 335/202
(58) Field of Search ..... 335/17, 132, 166–176, 335/202

(56) References Cited

U.S. PATENT DOCUMENTS 3,340,375 A * 9/1967 Kiesel et al. ..... 335/172
4,408,174 A * 10/1983 Seymour et al. ..... 335/20
5,036,303 A * 7/1991 Papallo, Jr. et al. ..... 335/17

FOREIGN PATENT DOCUMENTS

JP 6-139904 * 6/1994
JP 6-236726 * 6/1994

* cited by examiner

*Primary Examiner*—Lincoln Donovan
(74) *Attorney, Agent, or Firm*—Foley & Lardner

(57) ABSTRACT

A signal accessory for a molded case circuit breaker, with the circuit breaker having an operating mechanism with a cradle pin, a cross bar and a trip bar and a main breaker cover. The signal accessory comprises a signal accessory mounting having a bottom mount and a top mount coupled to the bottom mount with the top mount configured to receive a switch and engage the breaker cover in an accessory socket. A switch member is rotably mounted on the bottom mount with the switch member having an actuator lever in contact with the operating mechanism of the circuit breaker and an actuator pad in contact with a switch mounted on the top mount. When the circuit breaker is opened or closed the operating mechanism moves a cross bar coupled to the contact arm. The cross bar moves the actuator lever of the switch changing the state of the switch.

2 Claims, 10 Drawing Sheets

SIGNAL ACCESSORY FOR A MOLDED CASE CIRCUIT BREAKER

RELATED APPLICATION

This is a continuation of application Ser. No. 09/435,306, filed Nov. 5, 1999 abandoned.

FIELD OF THE INVENTION

The present invention relates generally to the field of circuit breakers, and more particularly to a molded case circuit breaker with a signal accessory.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially a stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 160 amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker.

In certain situations, an operator of an electrical system may desire to know if a circuit breaker is open, closed or tripped from a remote location. Such circumstances can include applications for maintenance and control. It may also be used in applications to provide synchronizing of several breakers, together with other accessories, to open and close several circuit breakers. One device used for signaling the state of a circuit breaker from a remote location is a signal accessory such as a bell switch or an auxiliary switch. Existing signal accessories currently used have several disadvantages. Some such signal accessory accessories must be installed in the circuit breaker housing behind the main cover and in close proximity to electrically live parts and connections. Other signal accessory accessories require the user to provide terminal connections to the switch wires. Further examples of present signal device accessories are designed to be used with a single circuit breaker frame, i.e., for each current rating of the circuit breaker a specially designed signal device accessory is required.

Thus, there is a need for a signal accessory to signal the state of a circuit breaker from a remote location that can be installed in the main cover of the circuit breaker without exposing the electrically live parts of the circuit breaker. There is a further need for a signal device that can be used with several circuit breaker frame sizes, that is, a single signal accessory that will operate over a wide range of constant current ratings for the circuit breaker. There is an additional need for a signal accessory with which a customer can connect its control wiring directly to the signal device without any additional rewiring. And further, there is a need for a signal device for a circuit breaker that can be installed in a circuit breaker utilizing a common latching protrusion that provides an audible snap fit installation.

SUMMARY OF THE INVENTION

The present invention is embodied in a signal accessory for a molded case circuit breaker, with the circuit breaker having an operating mechanism with a cradle pin, a cross bar and a trip bar and a breaker cover. The signal accessory comprises a signal accessory mounting having a bottom mount and a top mount coupled to the bottom mount with the top mount configured to receive a switch and engage the breaker cover in an accessory socket. A switch member is rotably mounted on the bottom mount with the switch member having an actuator lever in contact with the operating mechanism of the circuit breaker and an actuator pad in contact with a switch mounted on the top mount. When the circuit breaker is opened or closed the operating mechanism moves a cross bar which is attached to the movable contact arm. The cross bar moves the actuator lever of the switch which changes the state of the switch. Another embodiment of the present invention includes at least one additional switch mounted on the top mount and in operative contact with the actuator pad. The signal accessory mounting will accommodate a combination of auxiliary switches and an alarm switch. An operator of the signal accessory wires the auxiliary switch and the alarm switch to respective switching circuit and alarm circuit to provide remote indication of the status of the circuit breaker, i.e., open or closed, and tripped or untripped.

Another embodiment of the signal accessory comprises an integrated top and bottom mount with one switch member in operative contact with the trip bar of the circuit breaker and with another switch member in operative contact with the cross bar of the circuit breaker.

The present invention also embodies a method for signaling the state of a molded case circuit breaker having an operating mechanism configured to open and close a power circuit, a trip unit with an intermediate latch and a breaker cover, to a remote location, including the steps of installing a signaling accessory in the breaker cover with the signaling accessory having an alarm actuator in operative contact with the trip unit and a switch actuator in operative contact with the operating mechanism, wiring the signaling accessory having an alarm actuator to an alarm circuit and wiring the signaling accessory to the switch actuator in a switch circuit. In changing the state of the signaling accessory having the alarm actuator with one of either a cradle pin in the operating mechanism and a trip bar whereby the state of the circuit breaker is indicated in the alarm circuit and changing the state of the signaling accessory having the switch actuator in operative contact with a cross bar of the operating mechanism, whereby the state of the circuit breaker is indicated in the switch circuit as being either on or off. The method includes retaining the signaling accessory in the circuit breaker cover such that a snap is generated as the signaling accessory is nested in an accessory socket of the circuit breaker cover.

DETAILED DESCRIPTION OF THE PREFERRED EMBODIMENTS

Figure 1:
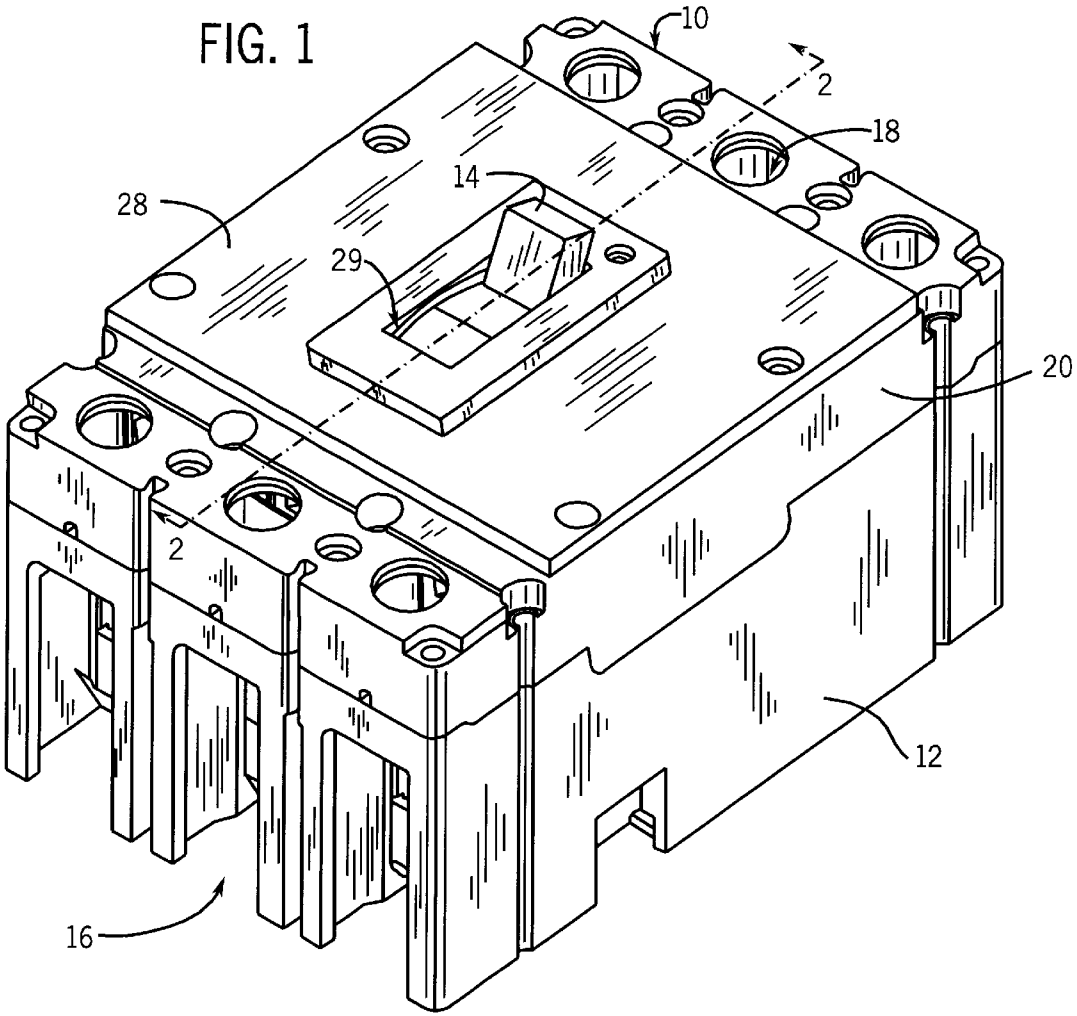
FIG. 1 is an isometric drawing of a molded case circuit breaker which includes an embodiment of the present bi-metal unit capable of broad rating applications.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
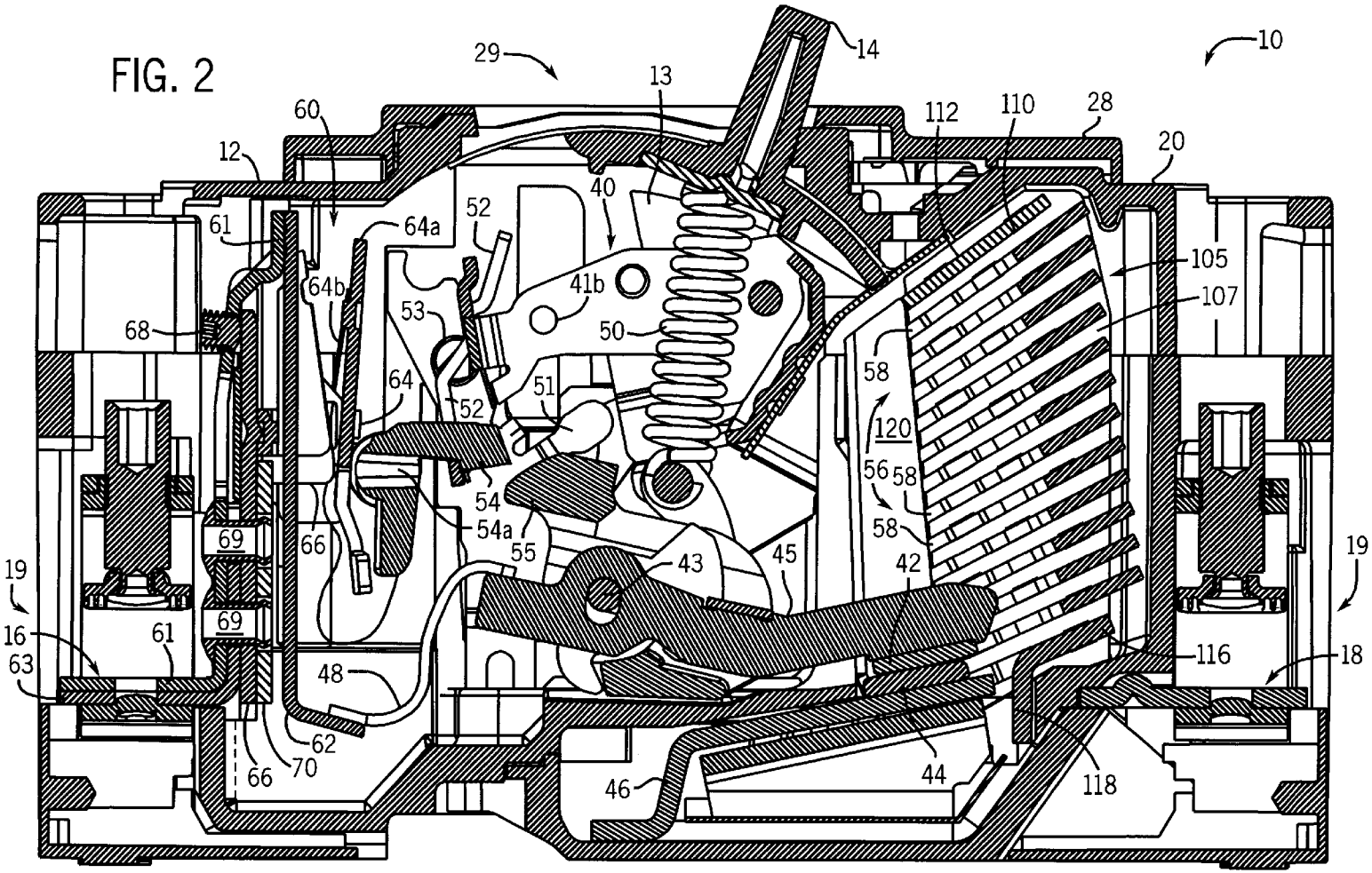
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
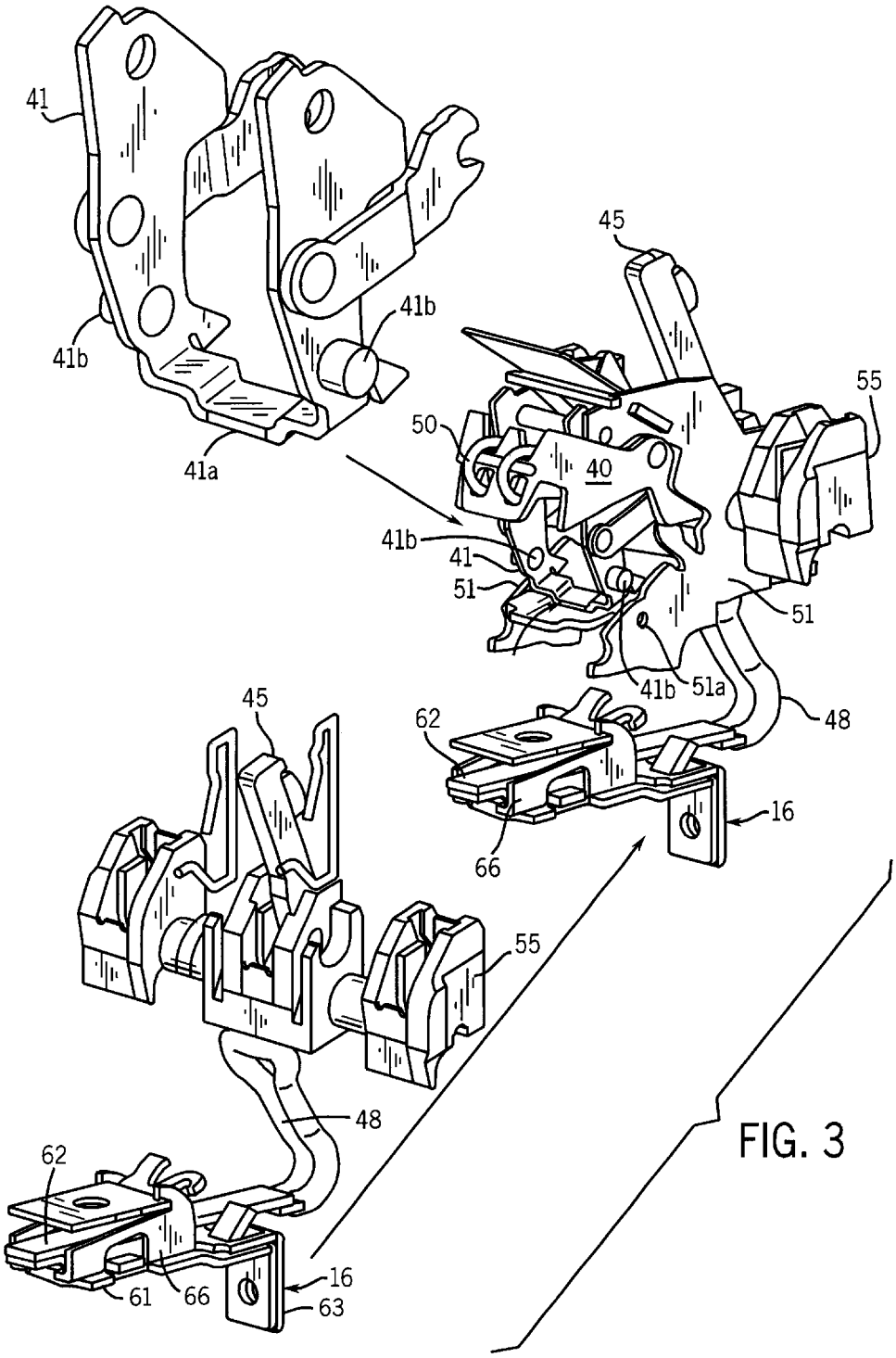
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
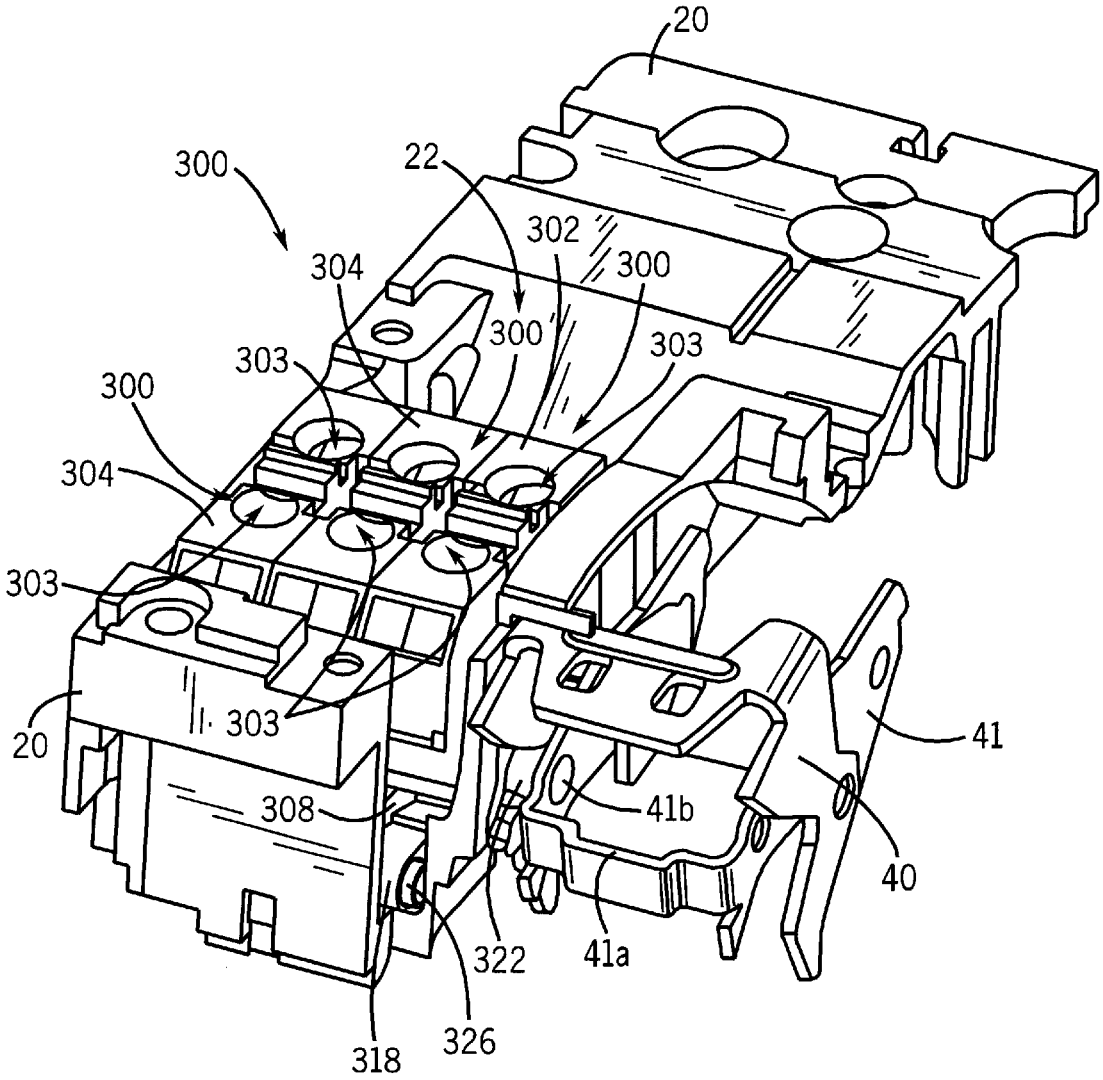
FIG. 4 is a partial cut-away illustration of the circuit breaker cover for the circuit breaker shown in FIG. 1 with an embodiment of the present signal accessory having one bell alarm switch and two auxiliary switches attached to the top mount and the bottom mount nested in the accessory socket of the breaker cover.

FIG. 4 illustrates the main breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such.as a shunt trip, will trip the circuit breaker 10, upon receiving a remote signal, by pushing the trip bar 54 in a counter clockwise direction causing release of the mechanism latch 52 of the operating mechanism 40. The shunt trip has a member protruding through one of the openings in the accessory socket 22 and engages the operating mechanism 40 via the trip bar 54. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

Referring to FIG. 4, there is illustrated a signal accessory 300 nested in an accessory socket 22 of a cover 20 of the circuit breaker 10. The signal accessory 300 illustrated consists of two auxiliary switches 304 and one alarm switch 302 mounted on a signal accessory mounting 301. Both the alarm switch 302 and each auxiliary switch 304 is a signaling device and are both of similar construction for interchangeability of parts. It should be understood that the signal accessory 300 can be configured to include three or fewer auxiliary switches 304. One or two auxiliary switches 304 can be combined with an alarm switch 302 as illustrated in FIG. 4. Each switch, 302, 304 is provided with terminals 303 for connecting the switches to an external circuit provided by an operator. The wiring from the external circuit is passed through a wire channel 27 in the circuit breaker 10 and connected to the respective terminals 304 of the switches 302, 304.

Each signal accessory 300 has a signal accessory mounting 301 having a bottom mount 308 and a top mount 306 coupled to the bottom mount 308 with the top mount 306 configured to receive a switch 302, 304 and 5 engage the breaker cover 20. An accessory detent 82 formed in the top mount engages a corresponding ledge, post or opening in the accessory socket 22 to secure the signal accessory mounting 301 in the accessory socket 20.

Figure 5:
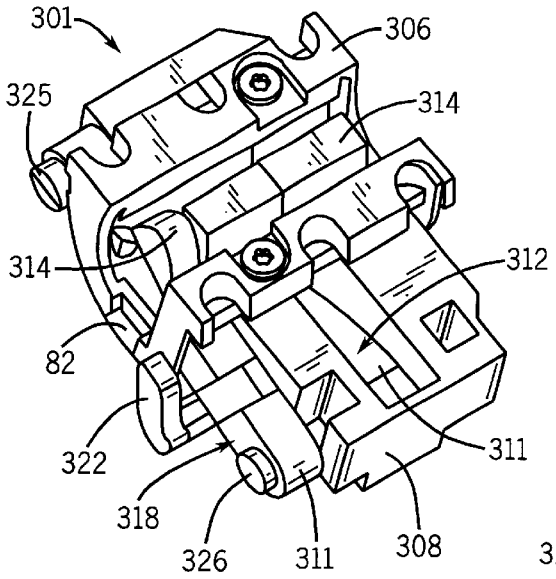
FIG. 5 is a perspective assembly view of an embodiment of a signal accessory mounting configured for one alarm switch and two auxiliary switches on one side of the circuit breaker handle.
Figure 6:
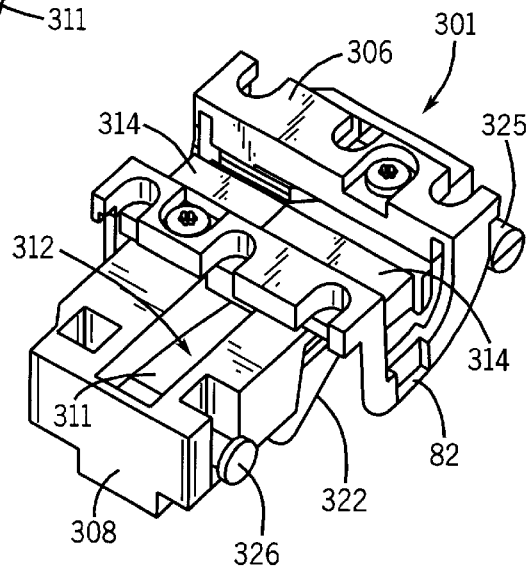
FIG. 6 is a perspective assembly view of an embodiment of a signal accessory mounting configured for at least three auxiliary switches.
Figure 7:
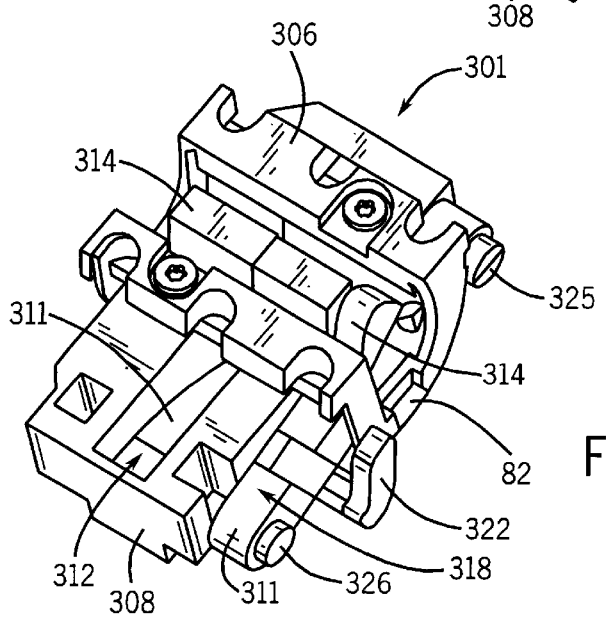
FIG. 7 is a perspective assembly view of an embodiment of a signal accessory mounting configured for one alarm switch and two auxiliary switches on another side of the circuit breaker handle, as shown in FIG. 4.
Figure 8:
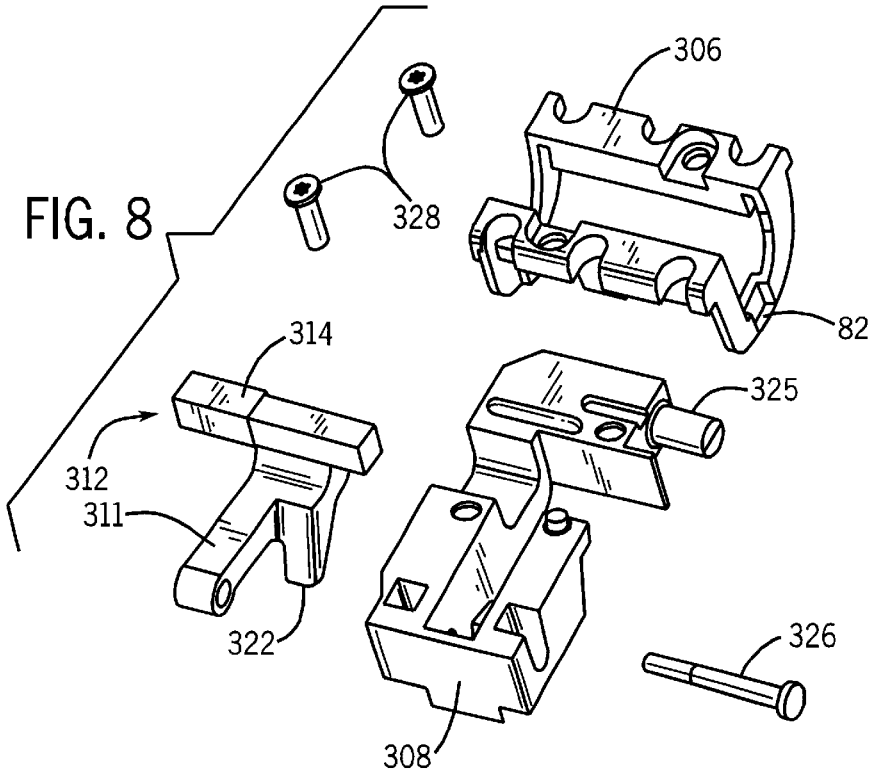
FIG. 8 is a perspective, exploded view of the signal accessory mounting shown in FIG. 6.
Figure 9:
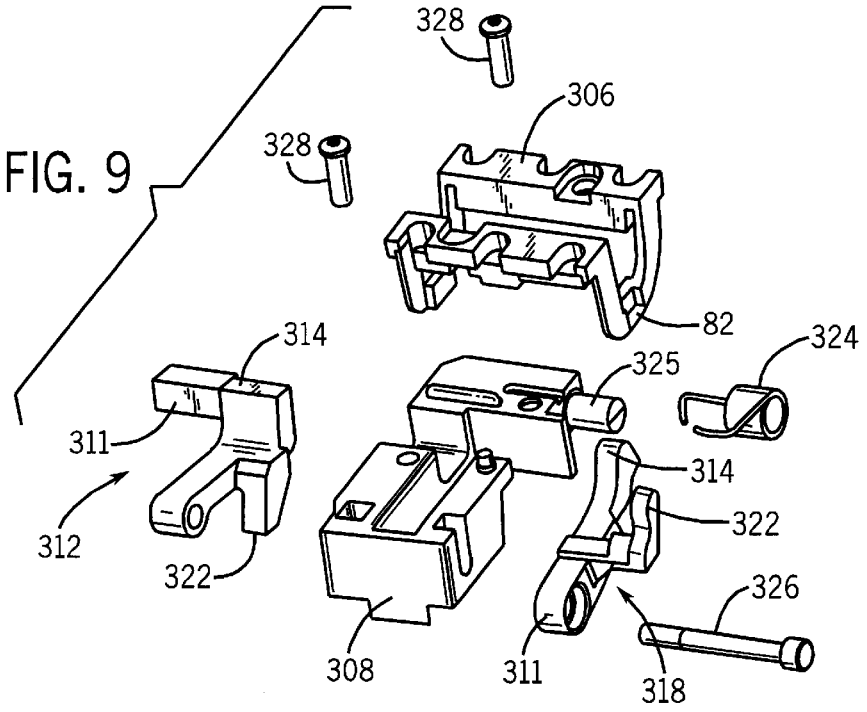
FIG. 9 is a perspective, exploded view of the signal accessory mounting shown in FIG. 7.
Figure 10:
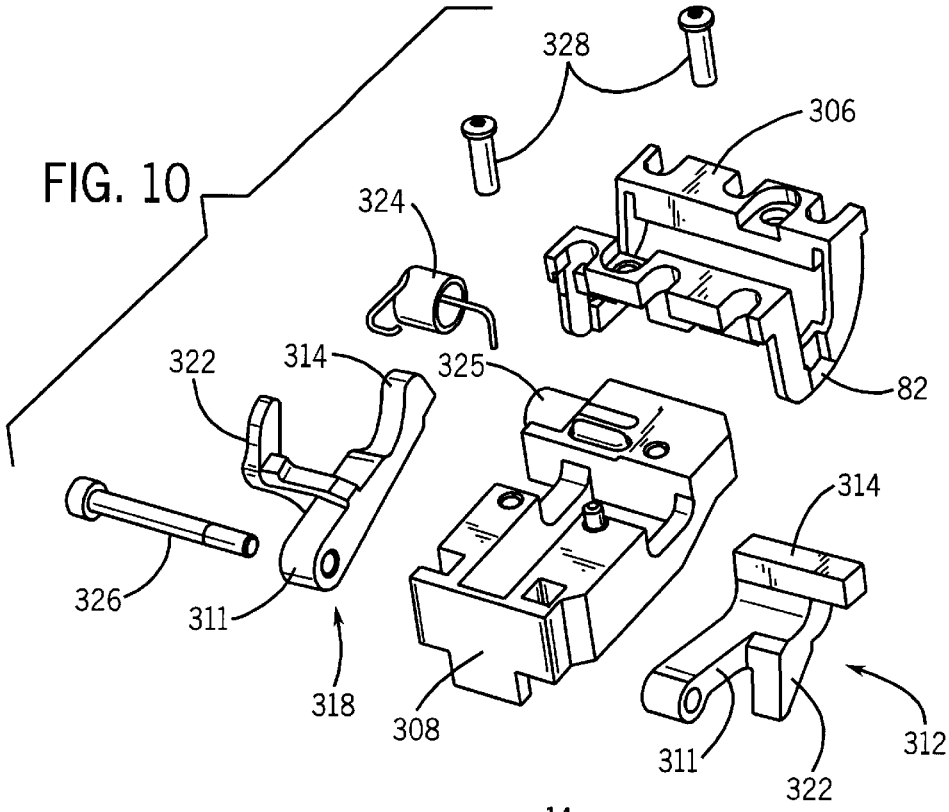
FIG. 10 is a perspective exploded view of the signal accessory mounting shown in FIG. 5.
Figure 16:
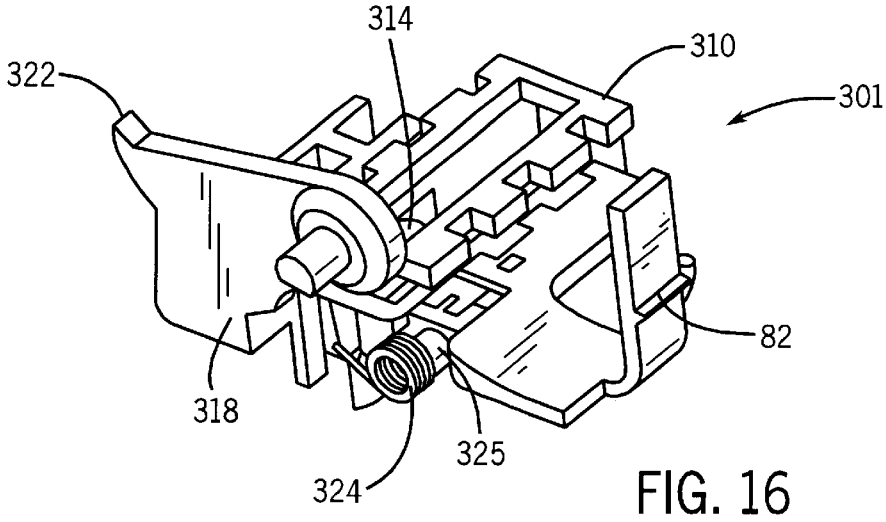
FIG. 16 is a perspective assembly view of an embodiment of a signal accessory mounting with an integrated top and bottom mount and with an actuator member that contacts the trip bar of the operating mechanism.
Figure 17:
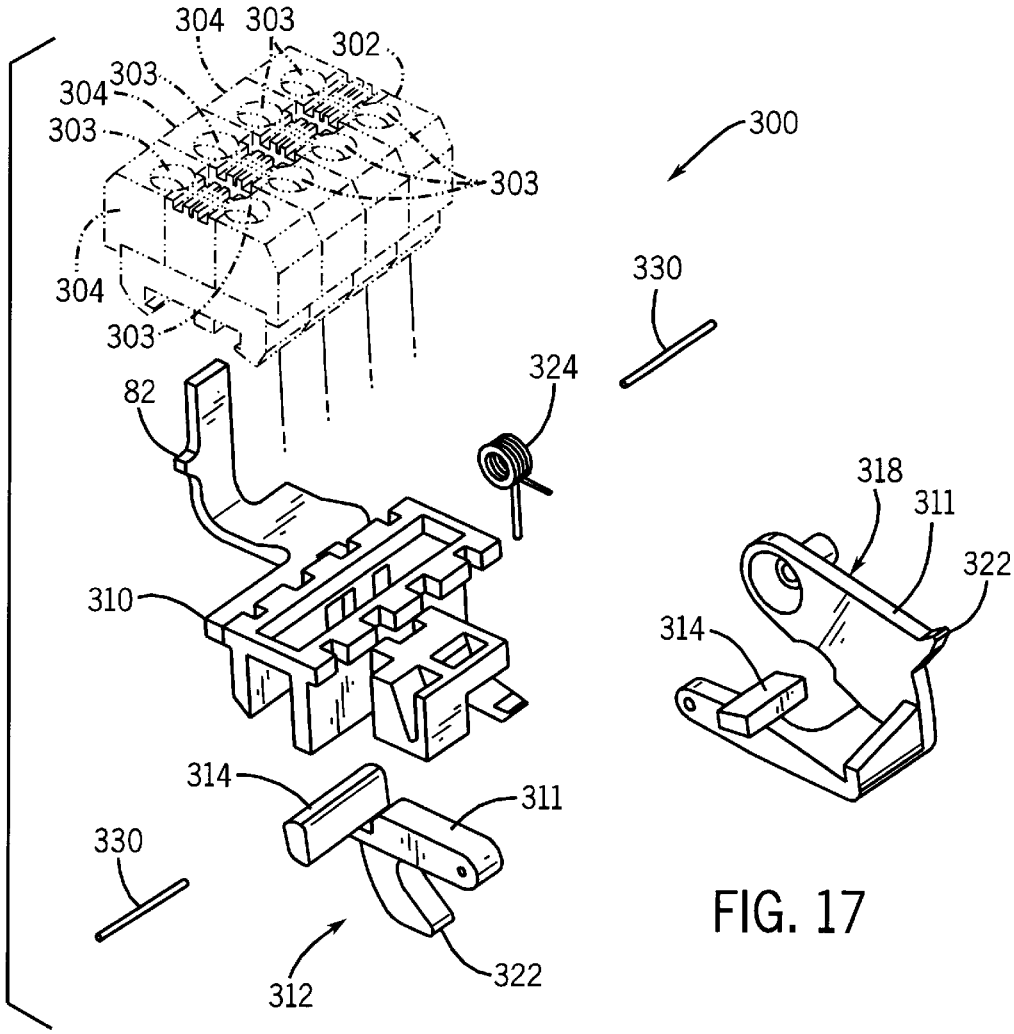
FIG. 17 is a perspective, exploded view of the signal accessory mounting illustrated in FIG. 6, including an illustration of four switches arranged to be attached to the mounting with two switches aligned to contact the alarm actuator and two switches aligned to contact the switch actuator.
Figure 18:
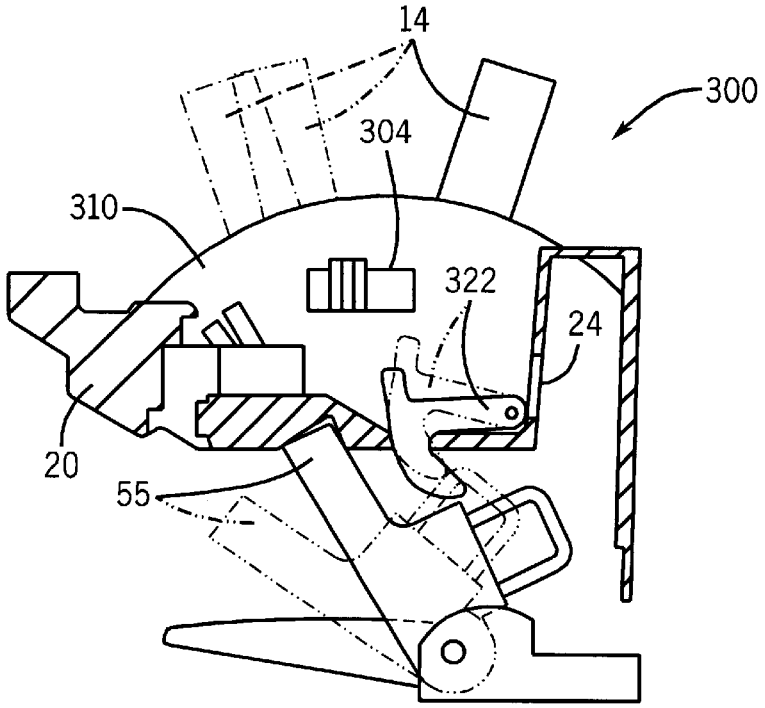
FIG. 18 is a partial side view of the signal accessory illustrated in FIG. 17 mounted in the breaker cover and in contact with the cross bar of the operating mechanisms of the circuit breaker.

FIGS. 5, 6 and 7 illustrate three embodiments of a signal accessory mounting 301. As mentioned above, the breaker cover 20 is provided with two accessory sockets 22, one on each side of the breaker handle 14 and pivoting member 13. The alarm switch 302 is operated, in one embodiment, by the cradle 41 of the operating mechanism 40 of the circuit breaker 10. Therefore, the alarm actuator 318 used to change the state of the alarm switch 302 engages the cradle pin 41*b* of the cradle 41 either from the left side or the right side of the handle 14. FIG. 4 illustrates a signal accessory 300 with the signal accessory mounting 301 configured as shown in FIG. 7. If the state of the alarm switch 302 is to be changed from the other side of the handle 14 with a signal accessory 300 mounted in another accessory socket 22, the configuration of the signal accessory mounting 301 illustrated in FIG. 5 would be used. FIG. 6 illustrates a signal accessory mounting 301 on which multiple auxiliary switches 304 are mounted. Since the auxiliary switch state is changed by a switch actuator 312 in contact with the cross bar 55 of the operating mechanism 40 of the circuit breaker 10, the embodiment of the signal accessory mounting 301 used for auxiliary switches 304 only can be mounted in either or any accessory socket 22 of the circuit breaker cover 20. FIG. 8 illustrates the embodiment of the auxiliary switch only signal accessory mounting (FIG. 8), and exploded views in FIGS. 9 and 10 illustrate the signal accessory mounting 301 that include an alarm switch 302 to be operated by one side or the other side of the circuit breaker handle 14. Each signal accessory mounting is provided with a switch member 311 rotably mounted on the bottom mount 308 with the switch member 311 having an actuator lever 322 and an actuator pad 314. The actuator pad 314 contacts the alarm switch 302 or the auxiliary switch 304 to change the state of the switches, i.e., "ON" or "OFF." The actuator pad 314 can be of any convenient and suitable configuration, with the preferred embodiment of the auxiliary switch actuator 312 having a rectangular shaped actuator pad 314 and the alarm actuator 318 having a curved finger type actuator pad 314. Each switch member 311 has an actuator lever 312 which operatively contacts a part of the circuit breaker mechanism to operate the switch 302, 304. In the auxiliary switch actuator, 312, the actuator lever 322 contacts the cross bar 55 of the operating mechanism 40 of the circuit breaker 10 and in the alarm actuator 318, the actuator lever 322 engages the cradle pin 41b of the cradle 41 of the operating mechanism 40 of the circuit breaker 10. In each embodiment of the signal accessory mounting 301 the switch member 311 is rotably mounted to the bottom mount 308 by a actuator pin 326 as shown in FIGS. 8, 9 and 10. In addition, in the alarm actuator 318 switch member 311, a torsion spring 324 is mounted on a spring post 325 biases the alarm actuator 318 switch member 311. A plurality of fasteners 328 secure the top mount 306 to the bottom mount 308 in the preferred embodiment. Other means for attaching the top mount to the bottom mount can be used such as rivets or adhesive. An alternative embodiment of the top mount 306 and bottom mount 308 is an integrally formed mount 310 as shown in FIGS. 16 and 17, which will be described below.

Figure 11:
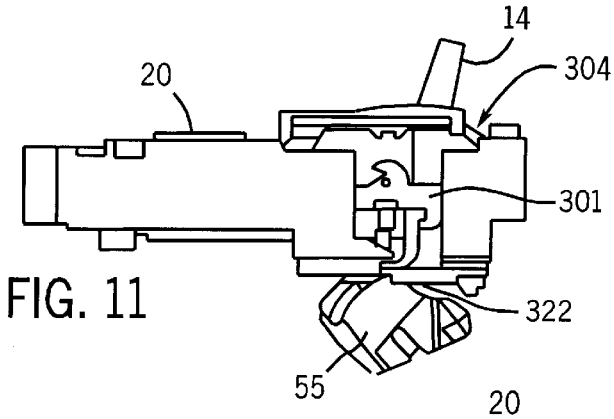
FIG. 11 is a partial cut-away side view of an auxiliary switch mounted in the breaker cover and in contact with the cross bar of the operating mechanism, with the breaker in the OFF position, i.e., main contacts open.
Figure 12:
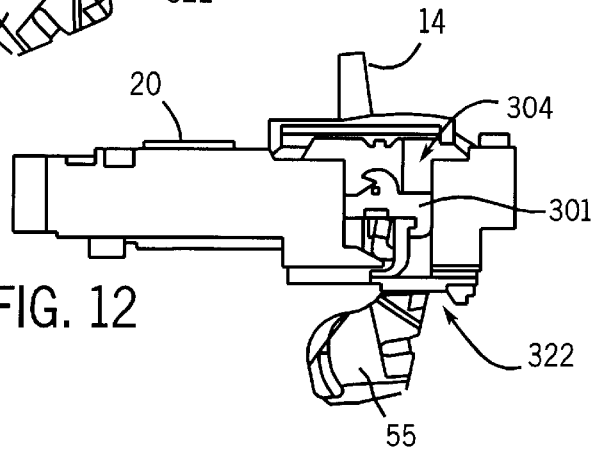
FIG. 12 is a partial cut-away side view of an auxiliary switch type signal accessory mounted in the breaker cover and in contact with the cross bar of the operating mechanism with the breaker in the ON position, i.e., main contacts closed.

The switches 302, 304 can be snap fit to the top mount 306 and are aligned by corresponding posts on the switches and openings in the top mount 306. When mounted on the top mount 306, the switches are operatively in contact with the actuator pad 314 of the switch member 311 for either the auxiliary switch actuator 312 or the alarm actuator 318. It should be understood, that several combinations of the alarm switch 302 and the auxiliary switch 304 can be assembled for separate signal accessory 300 to use with the circuit breaker 10. Such combinations can include one alarm switch 302 and two auxiliary switches 304 or one alarm switch alone, or one alarm switch and one auxiliary switch, or three auxiliary switches. The exemplar circuit breaker is a three pole breaker but it is contemplated that a single or four pole breaker will use the disclosed and equivalent signal accessory. Any combination of the auxiliary switches are operated by the switch member 311 actuator lever 322 in contact with the cross bar 55 of the operating mechanism 40 of the circuit breaker 10. The alarm switch 302 is operated by the actuator lever 322 engaged with the cradle pin 41b on either the left side or the right side of the cradle 41 of the operating mechanism 40 of the circuit breaker 10. FIGS. 11 and 12 illustrate the cross bar 55 engaging the actuating lever 322 of an installed auxiliary switch 304. As the main contacts 42, 44 of the circuit breaker 10 are moved from an open to a closed position, the cross bar 55 moves in unison with the movable contact arm 45. Therefore, when the movable contact arm 45 moves to an open position, the cross bar 55, changes the state of the auxiliary switch 304 and when the movable contact arm 45 is moved to a closed position, the cross bar 55 by the actuator lever 322, changes the state of the auxiliary switch 304 with which it is in contact. An operator of the circuit breaker wires the terminals 303 of the auxiliary switch to an external switch circuit to perform some function as determined by the operator, which circuit would indicate to the operator as to whether the circuit breaker contacts 42, 44 are either open or closed.

The alarm switch 302 utilizes the cradle pin 41*b* of the circuit breaker 10 to indicate the tripped position of the circuit breaker operating mechanism 40.

Figure 13:
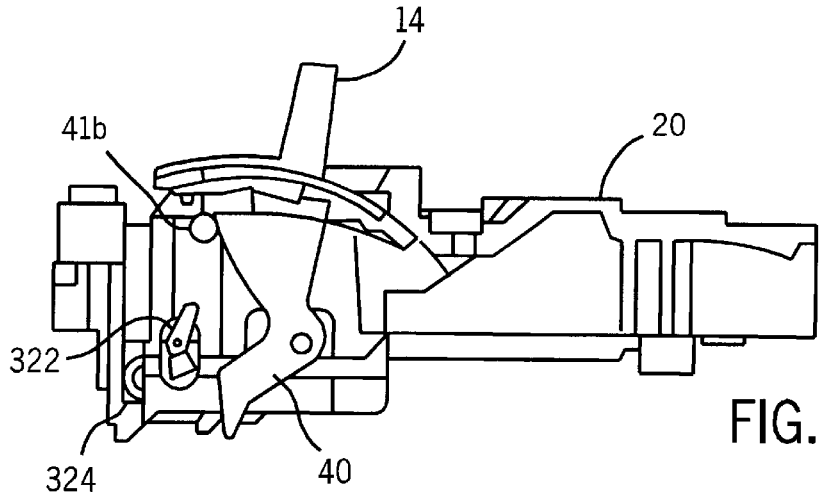
FIG. 13 is a partial cut-away side view of an alarm switch type signal accessory mounted in the breaker cover and not in contact with the cradle pin of the operating mechanism indicating that the breaker is in the TRIPPED position and the alarm switch closed.
Figure 14:
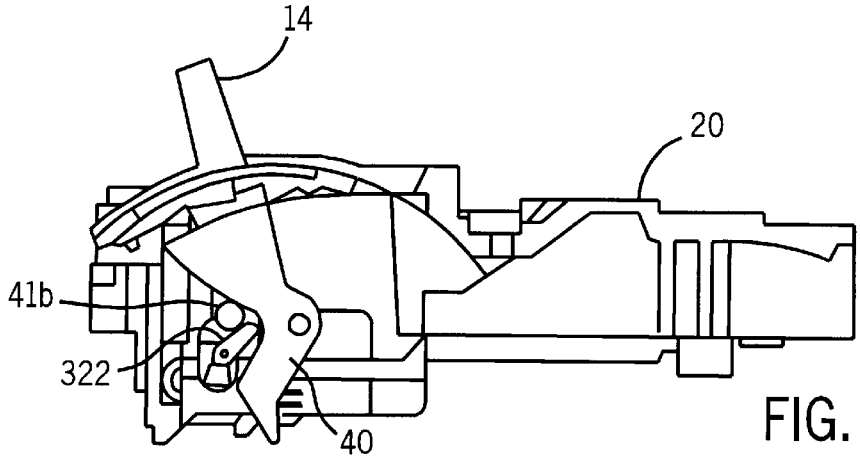
FIG. 14 is a partial cut-away side view of an alarm switch type signal accessory mounted in the breaker cover and in contact with the cradle pin of the operating mechanism indicating that the breaker is in the reset position and the alarm switch open.
Figure 15:
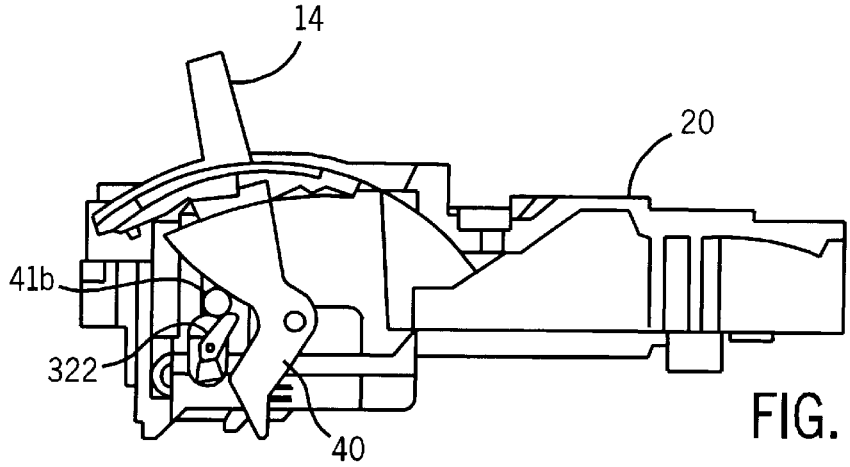
FIG. 15 is a partial cut-away side view of an alarm switch type signal accessory mounted in the breaker cover and in contact with the cradle pin of the operating mechanism indicating that the breaker is in the OFF position and the alarm switch open.

FIGS. 13, 14 and 15 illustrate the several states of the circuit breaker and corresponding state of the alarm switch 302. FIG. 15 illustrates the circuit breaker in the OFF position and the alarm switch open with the cradle pin 41*b* engaging the actuator lever 322 of the alarm actuator 318 switch member 311. FIG. 13 illustrates circuit breaker in a TRIPPED position with the alarm switch in a closed state. The torsion spring 324 biases the actuator lever 322 to close the alarm switch 302 since the cradle pin 41*b* is not in contact with the actuator lever 322 when the circuit breaker is tripped. FIG. 14 illustrates the circuit breaker in the reset position which also causes the cradle pin 41*b* to contact the actuator lever 322 and open the alarm switch 302 of the signal accessory 300. In each of the cases, an operator of the circuit breaker wires the alarm switch 302 to an alarm circuit which would indicate through a suitable alarm such as a bell, light or other suitable indicator, that the state of the circuit breaker as being either tripped or closed. Since the circuit breaker 10 can be opened or closed, i.e., on or off, by moving the handle 14 of the circuit breaker without tripping the trip mechanism, the use of auxiliary switches aid in the remote determination of a condition of the circuit breaker. Auxiliary switches can also be utilized to connect additional circuit breakers or operate other switching circuits to perform other functions as determined by an operator.

Figure 19:
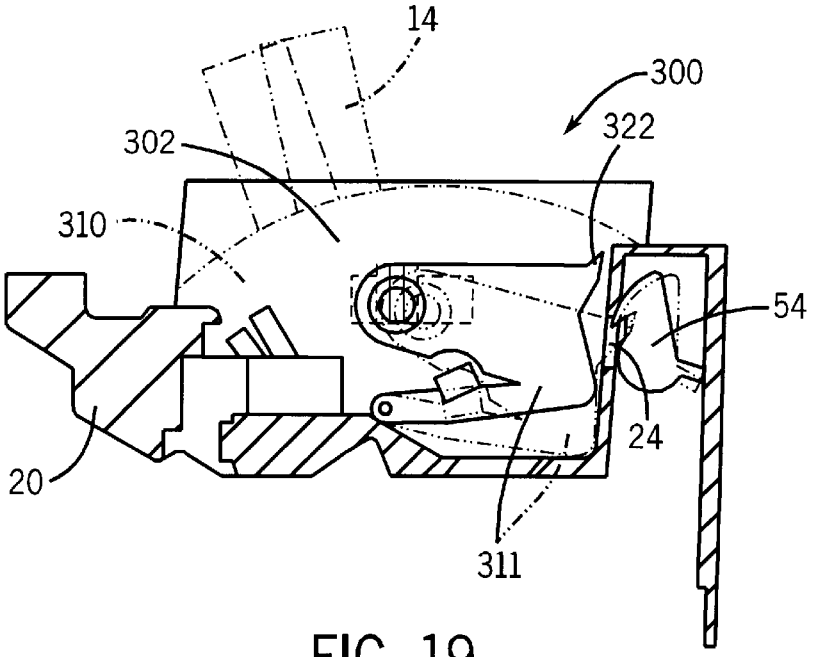
FIG. 19 is a partial side view of the signal accessory illustrated in FIG. 17 mounted in the breaker cover and in contact with the trip bar of the circuit breaker.

Another embodiment of the signal accessory 300 is illustrated in FIGS. 16, 17, 18 and 19. The illustrated signal accessory 300 utilizes a combined top mount and bottom mount as an integrated mount 310. The signal accessory mounting 301 snap fits into the accessory socket 22 of the circuit breaker cover 20 is described above. However, in this embodiment of the signal accessory 300, the trip bar 54 of the operating mechanism 40 of the circuit breaker 10 is utilized to indicate the trip condition of the circuit breaker 10. The lever actuator 322 of the alarm actuator 318 is in selective contact with the trip bar 54 as shown in FIG. 19. The switch actuator 312 utilizes an actuator lever 322 that is in contact with the cross bar 55 of the operating mechanism 40 of the circuit breaker 10. The embodiment of the signal accessory 300 illustrated in FIGS. 16–19, are typically used in circuit breakers having a rated continuous current of 600 to 1600 amps.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, the switches can be mounted to the signal accessory mounting with fasteners or the actuator pad can be of any convenient and suitable shape for engaging the switch mechanism in the alarm switch and auxiliary switch. It is also contemplated that an alectronic trip unit can be used. Additionally, it is also contemplated that the trip mechanism having a bi-metal trip unit or an electronic trip unit with a load terminal be housed in a separate housing capable of mechanically and electrically connecting to another housing containing the operating mechanism and line terminal thereby providing for a quick and easy change of current readings for an application of the circuit breaker contemplated herein. Other modifications will be evident to those with ordinary skill in the art.

What is claimed is:

1. A signal accessory for a molded case circuit breaker having an operating mechanism with a cradle pin, a cross bar and a trip bar, and a breaker cover, the signal accessory comprising:

a signal accessory mounting, having a bottom mount and a top mount coupled to the bottom mount, with the top mount configured to receive a switch and releasably engage the breaker cover;

a switch member rotably mounted on the bottom mount, with the switch member having an actuator lever in direct contact with the operating mechanism and an actuator pad; and at least two switches mounted on the top mount and in operative contact with the actuator pad, wherein one switch is in operative contact with the cradle pin and at least one switch is in operative contact with the cross bar.

2. A signal accessory for a molded case circuit breaker having an operating mechanism with a cradle pin, a cross bar and a trip bar, and a breaker cover, the signal accessory comprising:

a signal accessory mounting, having a bottom mount and a top mount coupled to the bottom mount, with the top mount configured to receive a switch and releasably engage the breaker cover;

a switch member rotably mounted on the bottom mount, with the switch member having an actuator lever in direct contact with the operating mechanism and an actuator pad; and at least two switches mounted on the top mount and in operative contact with the actuator pad, wherein one switch is in operative contact with the trip bar and at least one switch is in operative contact with the cross bar.

* * * * *